United States Patent [19]

Nagai et al.

[11] Patent Number: 4,598,431

[45] Date of Patent: Jul. 8, 1986

[54] SANITARY CLEANING APPARATUS

[75] Inventors: Kazutoshi Nagai, Nara; Hirofumi Aoyagi, Habikono; Ichiro Nasu; Shinichi Watanabe, both of Nara, all of Japan

[73] Assignee: Matsushita Electric Industrial Co., Ltd., Osaka, Japan

[21] Appl. No.: 748,669

[22] Filed: Jun. 25, 1985

[30] Foreign Application Priority Data

Jun. 29, 1984 [JP] Japan ..... 59-135640

[51] Int. Cl.[4] ..... A47K 4/00

[52] U.S. Cl. ..... 4/420.2; 4/443

[58] Field of Search ..... 4/420.2, 420.1, 420.4, 4/420.5, 443–448, DIG. 6

[56] References Cited

U.S. PATENT DOCUMENTS

| | | | |
|---|---|---|---|
| 2,875,450 | 3/1959 | Umann | 4/420.2 |
| 3,662,407 | 5/1972 | Colucci | 4/420.2 |
| 4,237,562 | 12/1980 | DuPont . | |
| 4,411,030 | 10/1983 | Kawai et al. | 4/420.2 |
| 4,422,189 | 12/1983 | Couvrette | 4/420.2 |
| 4,451,942 | 6/1984 | Hirano et al. | 4/420.4 |

FOREIGN PATENT DOCUMENTS

| | | | |
|---|---|---|---|
| 2751701 | 5/1979 | Fed. Rep. of Germany | 4/420.2 |
| 8303274 | 9/1983 | PCT Int'l Appl. | 4/420.2 |

*Primary Examiner*—Stephen Marcus
*Assistant Examiner*—L. J. Peters
*Attorney, Agent, or Firm*—Spencer & Frank

[57] ABSTRACT

A sanitary cleaning apparatus includes a cleaning water discharger and an additional apparatus (such as a drier) having a sanitary function, and a set of switches operatively connected to the cleaning water discharger and the additional apparatus, respectively. When a switch is manually operated, a first setting control sets the energization amount of the cleaning water discharger and/or the additional apparatus to a first set value. When a second setting control is manually operated, the energization amount is changed to a second set value set by the second setting control. When a human body detector is turned off, the energization amount is returned from the second value to the first value.

17 Claims, 12 Drawing Figures

SANITARY CLEANING APPARATUS

BACKGROUND OF THE INVENTION

The present invention relates to a sanitary cleaning apparatus for cleaning the private parts of a human body seated on a close stool with warm water.

A conventional sanitary cleaning apparatus will be explained with reference to FIGS. 1 to 4.

FIG. 1 is a perspective view of a sanitary cleaning apparatus installed, in which reference numeral 2 designates a seat mounted on a close stool 1, numeral 3 designates a sanitary cleaning apparatus proper, and numeral 4 designates a cistern for storing water for washing the interior of the stool 1.

FIG. 2 shows the configuration of a conventional sanitary cleaning apparatus, in which numeral 5 designates a nozzle for discharging the cleaning water against the parts to be cleaned of the human body seated on the seat 2, numeral 6 designates a water filter submerged in the water in the cistern 4, numeral 7 designates a water heater for storing and heating the cleaning water to the proper temperature, and numeral 8 designates a motor-driven pump for conveying water from the cistern 4 through the water filter 6 and supplying it to the water heater under pressure, and for discharging cleaning water derived from the warm water in the water heater 7 to the nozzle 5 under pressure. Numeral 9 designates a warm air outlet for blowing warm air for drying the parts wetted with the cleaning water, numeral 10 designates a wind tunnel, numeral 11 designates a fan for supplying air to the warm air outlet 9 through the wind tunnel 10, numeral 12 designates a motor for driving the fan 11, numeral 13 designates a heater for heating the air supplied from the fan to the proper temperature, numeral 14 designates a control section for controlling the water heater 7, pump 8, motor 12 and heater 13, and numeral 15 designates an operating section for the control section 14.

FIG. 3 is a front outside view of the operating section of a conventional apparatus, in which numeral 16 designates a cleaning adjustment knob for turning the cleaning water discharge means on and off and for setting the discharge pressure, and numeral 17 designates a drying temperature knob for turning the drying means on and off and switching the drying temperature.

In this configuration, when a user seated on the seat 2 is desirous of cleaning his private parts, he switches the cleaning adjusting knob 16 from "OFF" to the "ON" position. In compliance with an instruction from the control section 14, the pump 8 is started to wash the parts with the cleaning water discharged at a pressure set by a variable resistor controlled by the cleaning adjustment knob 16. When the user wants to dry the parts after washing, he returns the cleaning adjustment knob 16 to "OFF", and switches the drying temperature knob 17 from "OFF" to "LOW" or "HIGH". Then the motor 12 and the heater 13 are actuated by an instruction from the control section 14. Hot air is thus blown from the warm air outlet 9 toward the parts of the human body wetted with the cleaning water to dry them. The temperature of the warm air may be controlled by switching the drying temperature knob 17 between "LOW" and "HIGH". To finish the drying process, the user returns the drying temperature knob 17 to the "OFF" position.

In the cleaning processes of the conventional apparatus having this configuration, a user who wants to dry the parts is required to operate the drying temperature knob 17 after returning the cleaning adjusting knob 16 to "OFF". It is necessary to eliminate such complicated operations from a sanitary cleaning apparatus which is used by all family members, including children and the aged.

In another conventional apparatus, a set 18 of operating switches is separately provided for selecting the cleaning water discharge means and drying means as shown in FIG. 4. The cleaning adjustment knob 16 is fixed, and therefore upon operation of the set 18 of operating switch 18 switches by a second user, water at the pressure set by the first user is discharged from the nozzle 5 and applied to the parts of his body. This may be uncomfortable to the second user.

SUMMARY OF THE INVENTION

The present invention is intended to obviate these problems of the conventional apparatus, and the object thereof is to provide a sanitary cleaning apparatus comprising cleaning water discharge means for using warm water to clean the parts to be washed of a human body seated on the stool seat and drying means for using warm air to dry the parts wet with the cleaning water, the apparatus being improved in operating efficiency and being usable comfortably.

In order to achieve the above-mentioned object, there is provided according to the present invention a sanitary cleaning apparatus comprising means for discharging cleaning water, additional means having a function (such as drying) identical to or different from that of the cleaning water discharge means, means for turning the cleaning water discharge means and the additional means on and off, first setting a control means for setting selected one of the amount of actuation (e.g., pressure) of the cleaning water discharge means and the additional means, second setting control means for changing the amount set by the first setting control means, and human body detector means for detecting the presence or absence of a human body, wherein the actuation amount is set to the value of the first setting control means by manual operation of the on-off means, and is variable from this value by the operation of manual second setting control means, the actuation amount being returned to the value of the first setting control means by an absence detection signal of the human body detector means.

In this configuration, when the user is desirous of cleaning his private parts, he may use the on-off means to turn the cleaning water discharge means on and off, so that the parts of the user may be cleaned with the cleaning water at a discharge pressure set by the first setting control means. If the user wants to change the water discharge pressure, that is, if the pressure to be increased or decreased, the second setting control means may be used. If the additional means is a drying means to dry the parts of the user, the temperature of the drying means set by the first setting control means is obtained by manual operation of the means for turning the drying means on and off, and a subsequent change of temperature, if desired, may be effected by the second setting control means. When the user who has finished his use of the stool leaves the seat, the human body detector means detects it and clears the setting change by the second setting control means, thereby restoring the setting of the actuation amount to the value of the first setting control means.

In other words, once the first setting control means is set to desired values, simple operation of the on-off means for the cleaning water discharge means and the drying means makes comfortable use of the stool possible in all cases. If it is desired to change the pressure of the cleaning water discharge means or temperature of the drying means depending on the physical condition or taste of the user, the second setting control means is used. Further, when the user leaves the seat, the setting change by the second setting control means is cancelled, thereby automatically restoring the set value of the first setting control means. This achieves a high operating efficiency and eliminates the discomfort which might be caused by the failure to restore the set values.

BRIEF DESCRIPTION OF THE DRAWINGS

The present invention will be apparent from the following detailed description taken in conjunction with the accompanying drawings, in which.

DESCRIPTION OF THE PREFERRED EMBODIMENT

Figure 1:
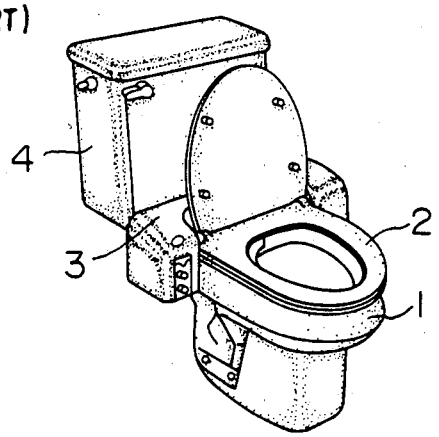
FIG. 1 (PRIOR ART)
FIG. 1 is a perspective view of a conventional sanitary cleaning apparatus as installed.
Figure 2:
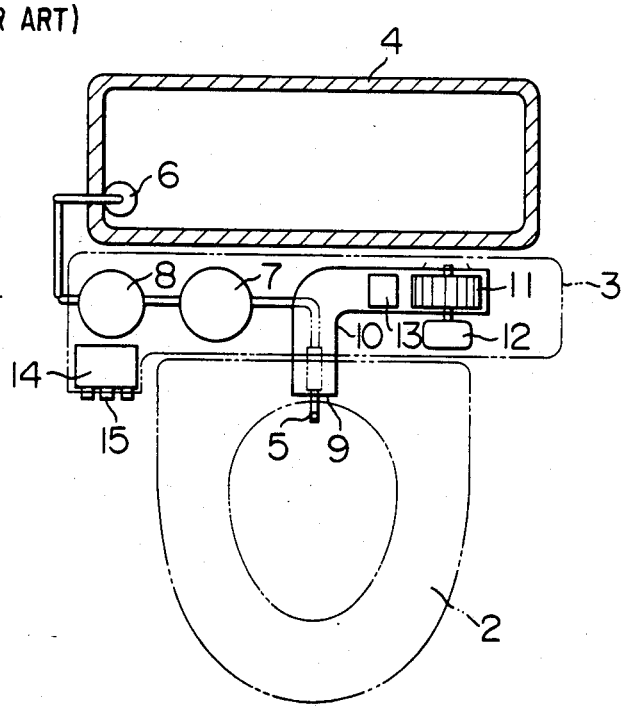
FIG. 2 (PRIOR ART)
FIG. 2 is a diagram showing the configuration of a conventional sanitary cleaning apparatus.
Figure 3:
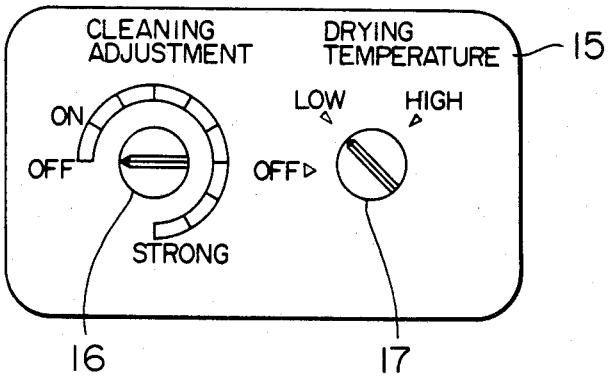
FIG. 3 (PRIOR ART)
FIGS. 3 and 4 are front views of the operating sections of the same sanitary cleaning apparatus.
Figure 4:
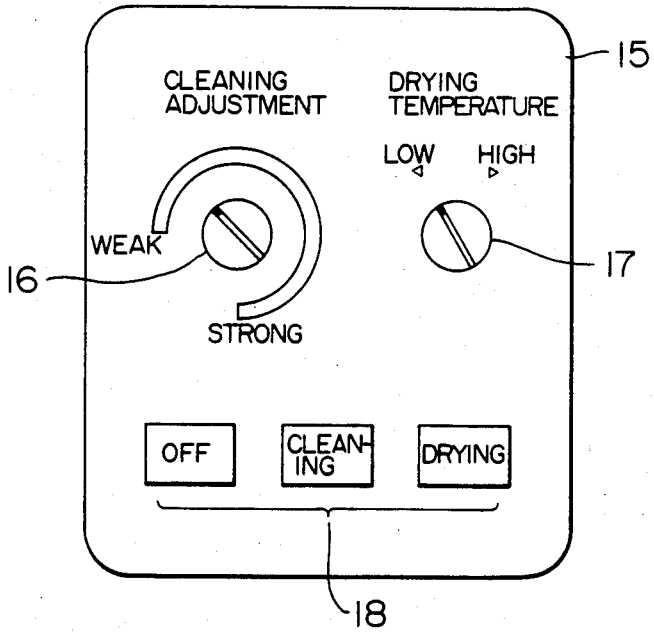
FIG. 4 (PRIOR ART)

An embodiment of the present invention will be explained below with reference to FIGS. 5 to 13. The same reference numerals are assigned to component elements in these drawings as were used to identify the same component elements in FIGS. 1 to 4.

Figure 5:
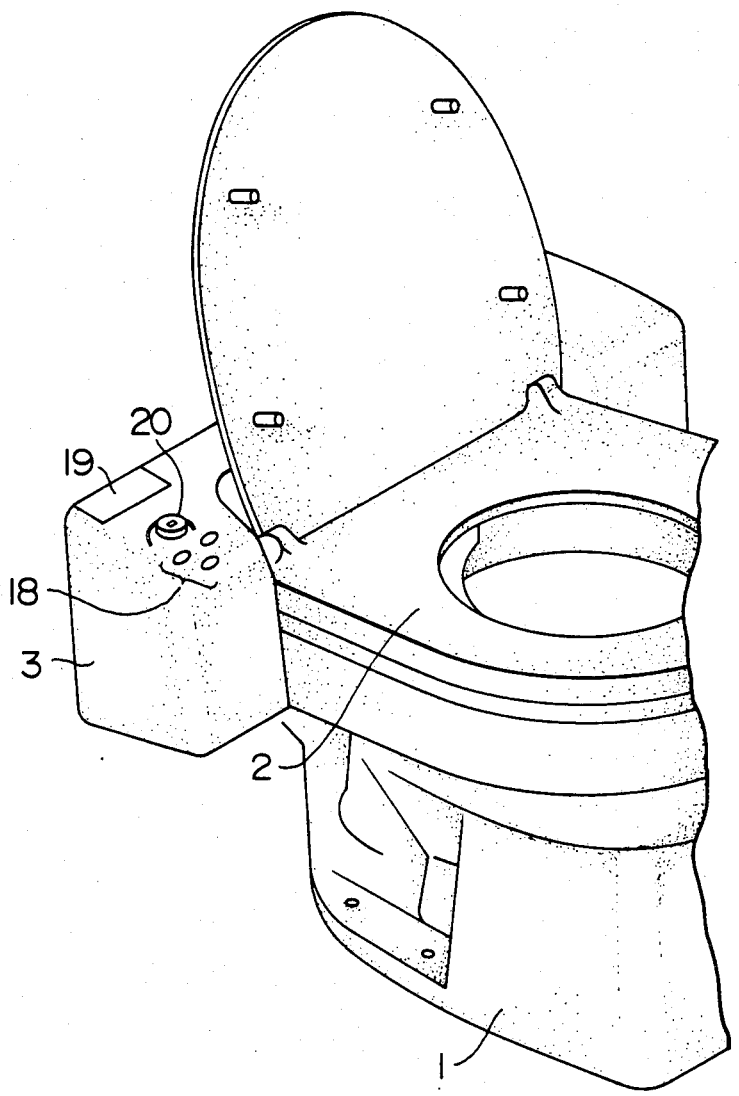
FIG. 5 is a perspective view showing the appearance of the part of a sanitary cleaning apparatus comprising first setting control means and second setting control means according to an embodiment of the present invention.

FIG. 5 illustrates part of a sanitary cleaning apparatus comprising first setting control means and second setting control means according to an embodiment of the present invention. The operating section 28 (see FIG. 9) for the first setting control means, which is not required in the ordinary course of usage, is contained in a body 3 covered by a lid 19. Numeral 20 designates a knob for the second setting control means.

Figure 6:
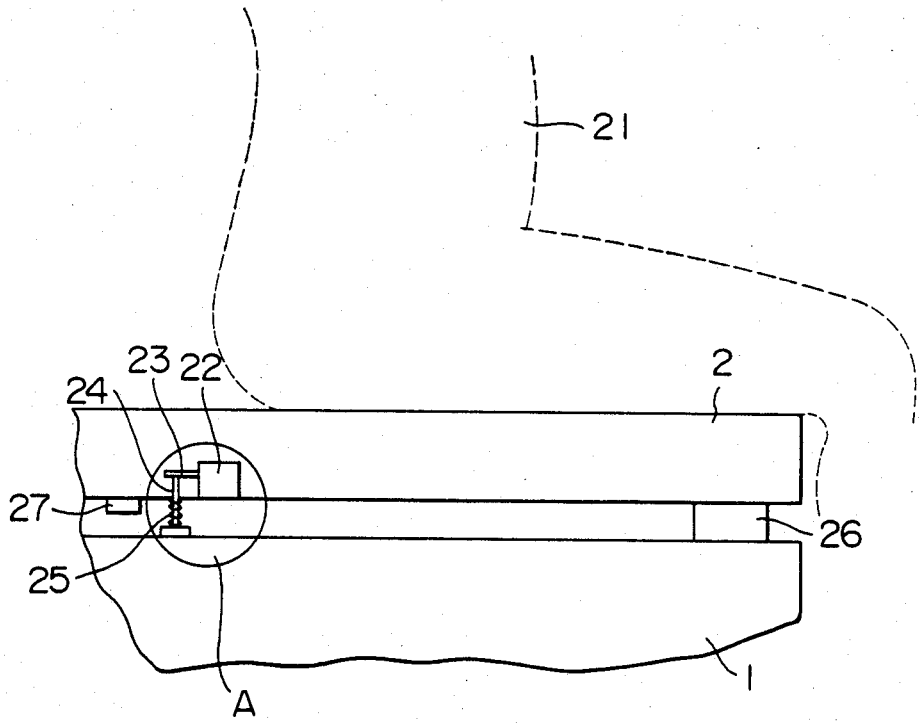
FIG. 6 is a partially cut-away sectional view showing a sanitary cleaning apparatus comprising a human body detector means according to an embodiment of the present invention.
Figure 7:
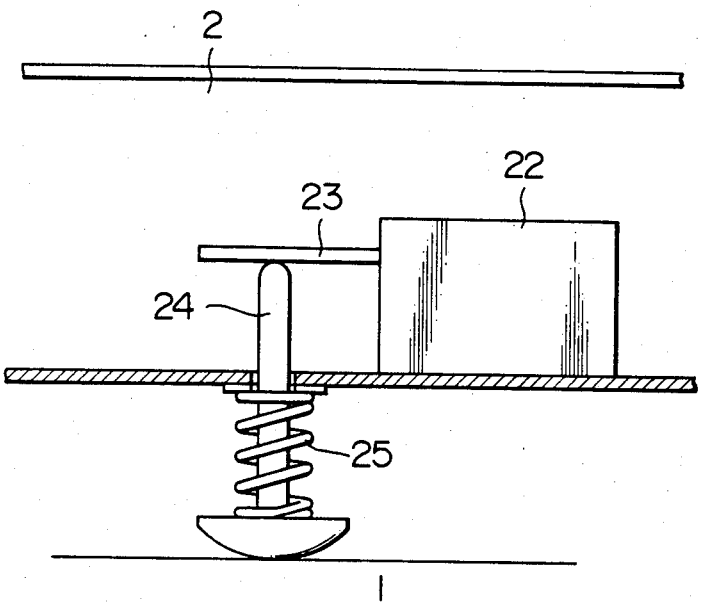
FIGS. 7 and 8 are partially enlarged views of the part A in FIG. 6.
Figure 8:
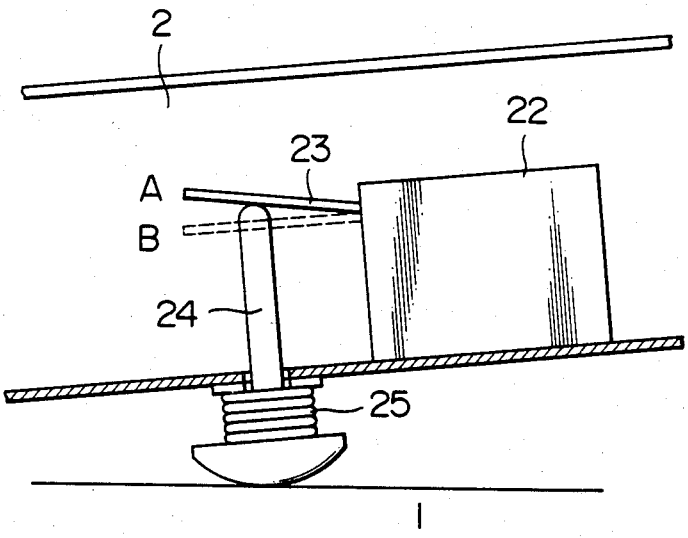

FIG. 6 is a partially cut-away sectional view of a sanitary cleaning apparatus comprising human body detector means according to an embodiment of the present invention. FIGS. 7 to 8 are enlarged partial views of the part A in FIG. 6. Numeral 22 designates a switch, numeral 23 designates a lever for imparting the vertical motion of a rod 24 to the switch 22, and numeral 25 designates a spring, these four parts making up the human body detector means. Numerals 26 and 27 designate rubber feet for absorbing the shock between the seat 2 and the stool 1 at the time of opening or closing the seat 2. When a human body 21 is not seated on the seat 2, the spring 25 is expanded as shown in FIG. 7. When the human body 21 is seated on the seat 2, the weight of the body 21 exerted on the seat 2 reduces the gap between the seat 2 and the stool 1 near the rubber foot 27 by the difference in thickness between the rubber feet 26 and 27, with the result that, as shown in FIG. 8, the spring 25 contracts and the lever 23 is pressed by the rod 24 into the state indicated by A, thereby turning the switch 22 on. When the human body 21 leaves the seat 2, the lever 23 is urged into the state B, as indicated by the dashed line in FIG. 8, to turn the switch 22 off. The on-off opertion of the switch 22 makes up a human body detection signal. As an alternative, human body detector means may be provided by a device for detecting the presence of a human body.

Figure 9:
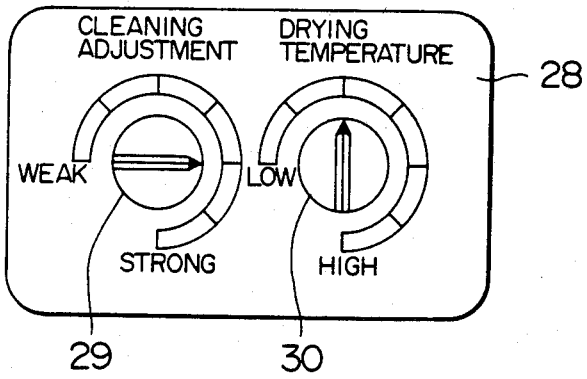
FIG. 9 is a front view of an operating section for the first setting control means according to an embodiment of the present invention.
Figure 10:
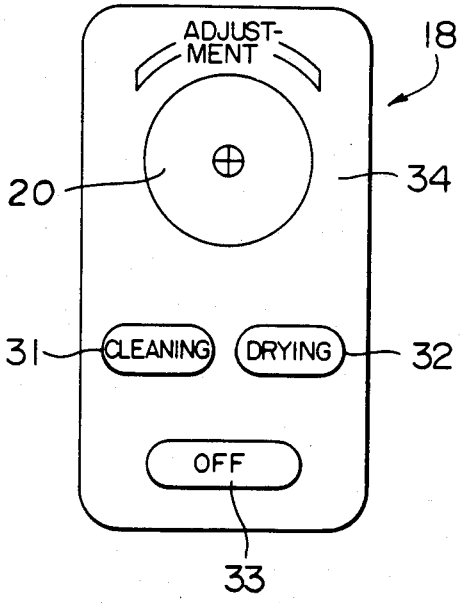
FIG. 10 is a front view of an operating section for the second setting control means and the means for turning the cleaning water discharge means and the drying means on and off.

FIG. 9 is a front view of an operating section 28 for the first setting control means according to an embodiment of the present invention, in which numeral 29 designates a cleaning adjustment knob and numeral 30 designates a drying temperature control knob. FIG. 10 is a front view of an operating section 34, on the surface of body 3, for the set 18 of switches of the the means for turning the cleaning water discharge means and the drying means on and off, and for the knob 20 of the second setting control means according to an embodiment of the present invention.

Numeral 31 designates a start-switch of the means for turning the cleaning water discharge means on and off, numeral 32 designates a start-switch of the means for turning the drying means on and off, and numeral 33 designates an off-switch of the means for turning the cleaning water discharge means and the drying means on and off. Each of the switches 31, 32 and 33 includes a key switch operable by soft touch.

Knob 20 for adjusting the knob the indication of which is represented by the second setting control means is used to change the setting of the warm air temperature of the drying means or the discharge pressure of the cleaning water discharge means after the turning on of the start-switch 31 or the start-switch 32. When the knob 20 is turned clockwise, the actuation amount is increased, that is, the water pressure or the temperature of the warm air is increased. When the knob 20 is turned counterclockwise, on the other hand, the actuation amount is decreased. The adjustment knob 20 is constructed in endless form.

Figure 11:
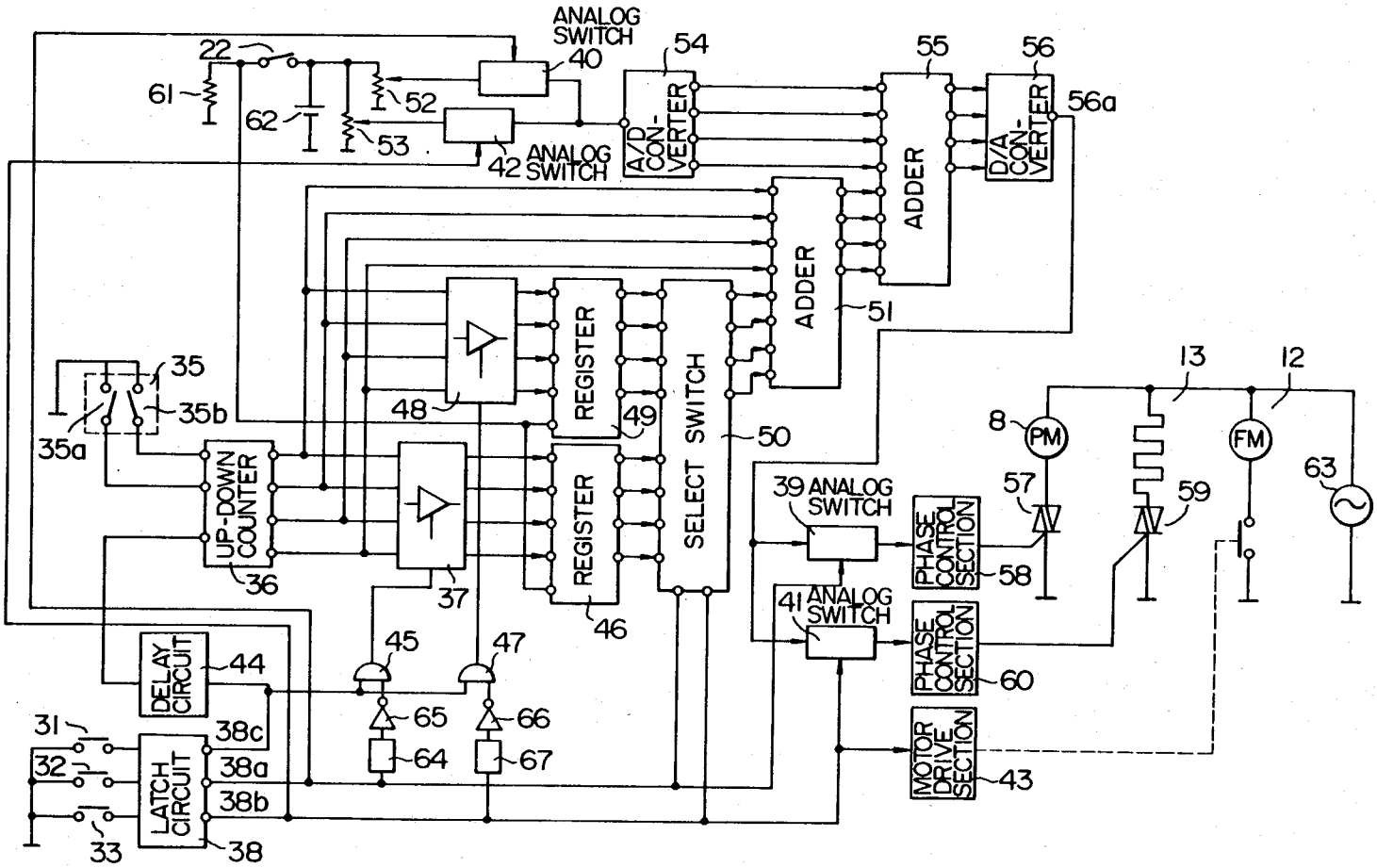
FIG. 11 is a block diagram of a control circuit for a sanitary cleaning apparatus according to an embodiment of the present invention.

FIG. 11 is a block diagram of a control circuit for a sanitary cleaning apparatus according to an embodiment of the present invention.

Numeral 35 designates pulse-generating circuitry that is interlocked with the knob 20 for the second setting control means, and includes a pulse switch **35*a* operable clockwise and a pulse switch 35*b* operable counterclockwise. Numeral 36 designates an up-down counter for counting the pulses produced by circuitry 35, that is, for counting up the pulse switch 35*a* and counting down the switch 35*b*. Numeral 37 designates a tri-state buffer, and numeral 38 a latch circuit supplied with the switching operation of the start-switch 31 of the means for turning the cleaning water discharge means on and off, the start-switch 32 of the means for turning the drying means on and off, and the off-switch 33 of the means for turning the cleaning water discharge means and the drying means off. Numeral 38***a* designates an output terminal for turning on the analog switches 39 and 40 by the operation of the start-switch 31 of the cleaning water discharge means. Numeral 38*b* designates an output terminal for turning on the analog switches 41 and 42 by the operation of the start switch 32 of the drying means, terminal 38*b* additionally being connected to motor drive section 43 for supplying power to the motor 12 for driving fan 11. Numeral 38*c* designates an output terminal for resetting the count of the counter 36 through a delay circuit 44 a predetermined time after operation of the off-switch 33, the start-switch 31 or the start-switch 32. Numeral 45 designates an AND gate for producing the logical product of the signal from the output terminal 38*c* and the signal produced from the output terminal 38*a*, applied through the delay line 64 and a signal-inverting inverter 65. When the output of the AND gate 45 is applied to the tri-state buffer 37, the value of the up-down counter 36 is transferred to a register 46. In similar manner, the value of the up-down counter 36 is transferred to a register 49 when the output of the AND gate 47 is applied to the tri-state buffer 48. Numeral 66 designates an inverter, and numeral 67 a delay line. The values in the registers 46 and 49 are reset when the switch 22 of the human body detector section is turned off. Numeral 50 designates a select switch for selecting the register 46 or 49, which select switch applies the value of the register 49 to the adder 51 when a signal for turning on the analog switch 39 is applied thereto from the output terminal 38*a* of the latch circuit 38. When the signal for turning on the analog switch 41 is applied thereto from the output terminal 38*b* of the latch circuit 38, on the other hand, the value of the register 46 is applied to the adder 51. The output signals of this select switch 50 and the up-down counter 36 are added at the adder 51.

Numeral 52 designates a variable resistor making up part of the first setting control means for setting the discharge pressure from the cleaning water discharge means, and numeral 53 designates a variable resistor making up part of the first setting control means for setting the temperature of the warm air of the drying means. The output voltage of the variable resistor 52 or 53 is selected by the analog switches 40 and 42, and A/D converted by an A/D converter 54 for converting an analog value into a binary output, so that the output signal of the A/D converter 54 is added to that of the adder 51 at another adder 55. The binary output of this adder 55 is converted into an analog value by a D/A converter 56. The output voltage of the D/A converter 56 is applied through analog switch 39 to a phase control section 58 for a bidirectional thyristor 57 for driving the cleaning pump 8, making up the cleaning water discharge means, and through analog switch 41 to a phase control section 60 for a bidirectional thyristor 59 for driving the heater 13.

Numeral 61 designates a resistor, 62 a DC power supply and 63 a commercial power supply.

Figure 12:
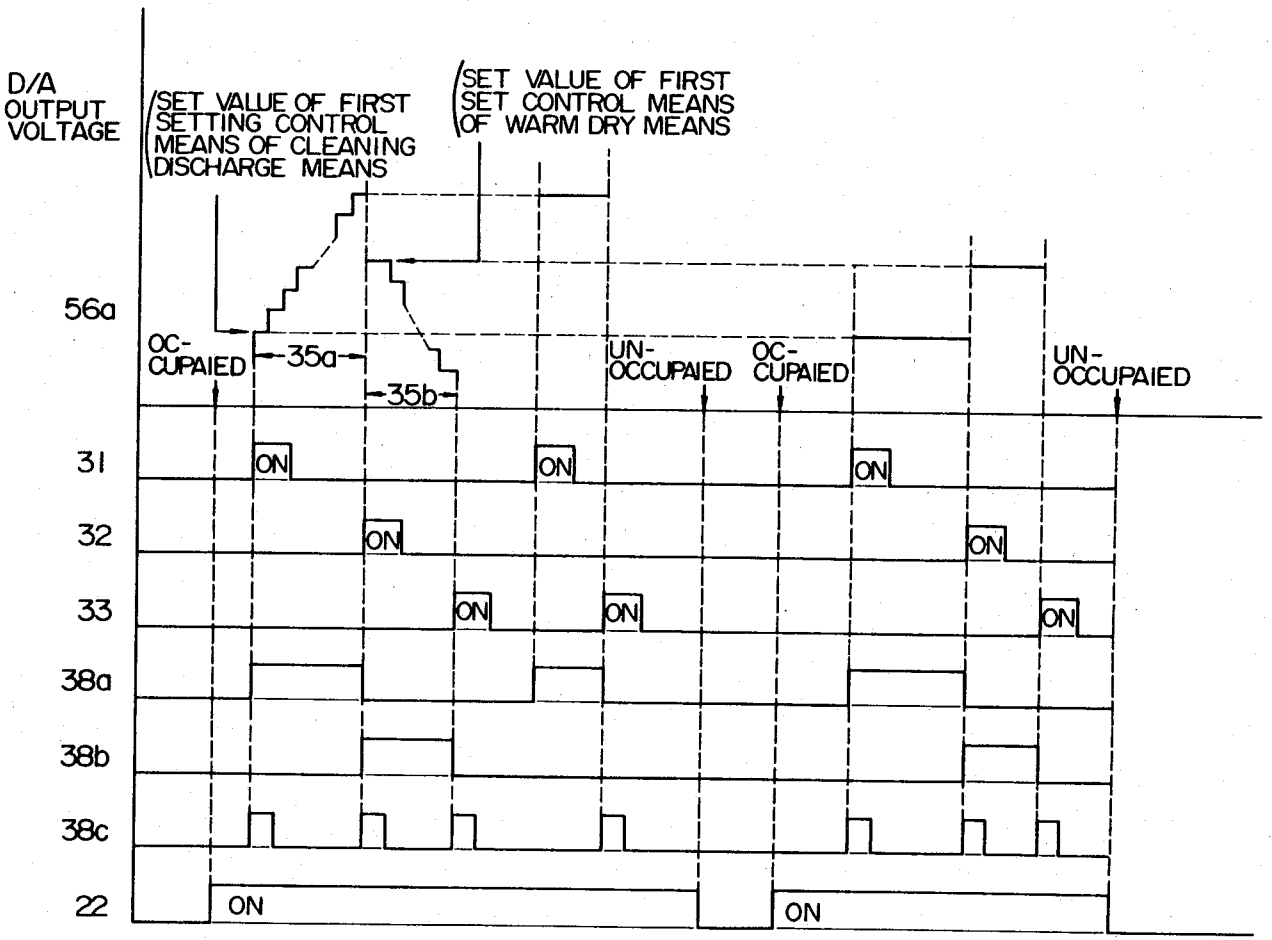
FIG. 12 is a diagram showing the output waveform of a D/A converter and an operation sequence of a latch circuit and a human body detector means.

FIG. 12 is a diagram showing output voltages waveforms produced from the output terminal 56*a* of the D/A converter 56 and the switch 22 of the human body detector means and waveforms produced by the operation of the start-switch 31 of the means for turning the cleaning water discharge means on and off, the start-switch 32 of the means for turning the drying means on and off, and the off-switch 33 of the means for turning the cleaning water discharge means off or the drying means.

When the human body 21 is seated on the seat 2, the switch 22 is turned on. If the start-switch 31 for the means for turning the cleaning water discharge means on and off is closed under this condition, the output 38*a* of the latch circuit 38 becomes "high" and a reset pulse is produced from the terminal 38*c*. Under this condition, the output voltage 56*a* of the D/A converter 56 corresponds to the discharge from pressure set for the cleaning water discharge means by the variable resistor 52, this value representing the set value of the first setting control means of the cleaning water discharge means. When the knob 20 is turned clockwise, the switch 35*a* is energized to increase the amount of actuation (that is, discharge pressure) for the cleaning water discharge means. If the start-switch 32 of the means for turning the drying means on and off is closed under this condition, the output 38*b* of the latch circuit 38 becomes "high", while at the same time a reset pulse is produced from the terminal 38*c*. This reset pulse is applied through the delay line 44 to reduce the count of the up-down counter 36 to zero a predetermined time later. The count of the up-down counter 36 immediately before the zero resetting is such that, since the "high" or "low" state of the terminal 38*b* is delayed by the delay line 67, the output of the inverter 66 is kept "high" for a certain period of time after the closure of switch 32. This output is applied to the AND gate 47 along with the reset pulse from the terminal 38*c*, and the resulting signal is applied to the the tri-state buffer 48, which is controlled by the output signal of the AND gate 47.

Under this condition, the output voltage at terminal 56*a* of the D/A converter 56 starts at the warm air temperature set by variable resistor 53, so that when the knob 20 is turned counterclockwise, the switch 35*b* is actuated to reduce the output voltage, thus reducing the warm air temperature. After that, when the off-switch 33 is closed, a reset pulse is applied from the terminal 38*c* of the latch circuit 38 through the delay line 44 to the up-down counter 36. A predetermined time later, the count of the up-down counter 36 is reduced to zero. Under this condition, the count of the up-down counter 36 immediately before being reset to zero is such that, since the terminal 38*a* is "low", the output of the inverter 65 is kept "high" for a predetermined period of time after the off-switch 33 is closed so that the output is applied to the AND gate 45 along with the reset pulse from the terminal 38*c*. The output of the AND gate 45 is applied to the tri-state buffer 37, which is controlled by the output signal of and AND gate 45. After that, when the on switch 31 is turned on before leaving the seat, the apparatus may be used at the value set by the variable resistor 52 on the previous occasion. This is also the case when the switch 32 is turned on.

When the seat 2 is left after use, the switch 22 is opened and the registers 49 and 46 are reset to zero. As a result, the initial setting for operation of the on-off means of the cleaning water discharge means and the drying means following the next seating of a human body is the same value as set by the first setting control means.

In this configuration, the pressure of the cleaning water of the cleaning water discharge means or the temperature of the warm air from the drying means may be set freely by the variable resistors 52, 53. Further, as long as the human body detector means is not turned off when the cleaning water discharge means is on, the second setting control means can be operated followed by the operation of the on-off means of the drying means and the turning-on of the cleaning water discharge means again. Then the amount of actuation equivalent to the set value used on the previous occasion is realized. In the case where the apparatus is used while the human body detector means is turned on, therefore, it is not necessary to operate the second setting control means.

Exactly the same advantage as the one mentioned above is obtained if the cleaning water discharge means appies the cleaning water to the anus of a human body and the additional means applies cleaning water to the private parts of a female, or if the cleaning water discharge means applies the cleaning water to the private parts of a female and the additional means dries the parts.

It will be understood from the foregoing description that according to the present invention, there is provided a sanitary cleaning apparatus comprising means for discharging the cleaning water, additional means having a function (such as drying) identical to or different from that of the cleaning water discharge means, means for turning the cleaning water discharge means and the additional means on and off, first setting control means provided separately from the on-off means for setting at least one of the amount of actuation of the cleaning water discharge means and the additional means, second setting control means for changing the set value of the first setting control means, and human body detector means for detecting the presence or absence of a human body, wherein the actuation amount of the cleaning water discharge means or the additional means is set by the first setting control means, when the on-off means is manually actuated but can be adjusted by manual operation of the second setting control means, the actuation amount being returned to the setting of the first setting control means by the human body detection signal of the human body detector means.

In this configuration, if a user who is desirous of cleaning the parts turns on the on-off means for the cleaning water discharge means; the parts of the user are cleaned with a discharge pressure set by the first setting control means. If the pressure of the the cleaning water is to be changed subsequently, that is, if the amount of actuation of the cleaning water is to be increased or decreased, the second setting control means is used. If a drying means makes up the additional means employed in the apparatus, the temperature set by the first setting control means is obtained for drying by turning on the on-off means of the drying means. If the temperature is to be changed further subsequently, the second setting control means is used. When the user leaves the seat upon termination of use of the stool, the departure is detected by the human body detector means and the setting change by the second setting control means is reset, so that the set amount of actuation is returned to the setting of the first setting control means.

Specifically, once a desired value is set by the first setting control means, the constantly comfortable use of the stool becomes possible merely by simple operation of the on-off means for the cleaning water discharge means and the drying means each time of use. If a change of the actuation amount of the cleaning water discharge means or the drying means is desired, depending on the physical conditions or taste of the user, the second setting control means handles the work. Further, only when the user leaves the seat, the setting change by the second setting control means is reset to automatically return the setting to that of the first setting control means, thereby leading to a high operating efficiency and elimination of discomfort which might otherwise be caused by the failure to restore the set value.

What we claim is:

1. A sanitary cleaning apparatus for use by a person sitting on a toilet stool, comprising: electrically operated cleaning means for performing a sanitary function for the person by discharging cleaning water to part of the body of the person; electrically operated additional means for performing an additional sanitary function for said person; means for providing electricity to operate said cleaning means and said additional means; on-off means for turning said cleaning means and said additional means, respectively, on and off; first setting control means for setting the level of the electrical power supplied to at least one of said cleaning means and said additional means; second setting control means for changing the level of the electrical power set by the first setting control means; and human body detector means for detecting the presence or absence of the person on the stool, wherein the electrical power level set by said first setting control means is provided to a respective one of said cleaning means and said additional means by manual operation of said on-off means, the power level set by said first setting control means being variable by manual operation of the second setting control means but being returned to the power level set by said first setting control means in response to a signal provided by said human body detector means.

2. A sanitary cleaning apparatus according to claim 1, wherein said human body detector means comprises a switch which is actuated when the person is seated on the stool.

3. A sanitary cleaning apparatus according to claim 1, wherein said second setting control means comprises means for selectively increasing and decreasing the power level set by said first setting control means.

4. A sanitary cleaning apparatus according to claim 1, wheren said first setting control means comprises a variable resistor.

5. A sanitary cleaning apparatus according to claim 1, wherein said second setting control means comprises an up-down counter, and means for supplying pulses to said counter.

6. A sanitary cleaning apparatus according to claim 1, further comprising a housing having a cover, said first setting control means being installed under said cover.

7. A sanitary cleaning apparatus according to claim 1, wherein said second setting means comprises a rotatably mounted knob.

8. A sanitary cleaning apparatus according to claim 1, wherein said cleaning means is used for the anus of the person, and said additional means comprises a bidet cleaning water discharge means.

9. A sanitary cleaning apparatus for use by a person sitting on a toilet stool, comprising: electrically operated cleaning means for discharging cleaning water to part of the body of the person; electrically operated drying means for drying the part cleaned; means for providng electricity to operate said cleaning means and said drying means; on-off means for turning said cleaning means and said drying means, respectively, on and off; first setting control means for setting the level of the electrical power supplied to at least one of said cleaning means and said drying means; second setting control means for changing the level of the electrical power set by said first setting control means; and human body detector means for detecting the presence or absence of the person on the stool, wherein the electrical power level set by the first setting control means is provided to a respective one of said cleaning means and said drying means by manual operation of said on-off means, the power level set by said first setting control means being variable by manual operation of said second setting control means but being returned to the power level set by said first setting control means in response to a signal provided by said human body detector means.

10. A sanitary cleaning apparatus according to claim 9, wherein said human body detector means comprises a switch which is actuated when the person is seated on the stool.

11. A sanitary cleaning apparatus according to claim 9, wherein the second setting control means comprises means for selectively increasing and decreasing the power level set by said first setting control means.

12. A sanitary cleaning apparatus according to claim 9, wherein the first setting control means comprises a variable resistor.

13. A sanitary cleaning apparatus according to claim 9, wherein said second setting control means comprises an up-down counter and means for supplying pulses to said counter.

14. A sanitary cleaning apparatus according to claim 9, further comprising a housing having a cover, said first setting control means being installed under said cover.

15. A sanitary cleaning apparatus according to claim 14, wherein said second setting control means comprises a rotatably mounted knob.

16. A sanitary cleaning apparatus according to claim 9, wherein said on-off means comprises a switch for starting said cleaning means and an adjacent switch for starting said drying means.

17. A sanitary cleaning apparatus according to claim 9, wherein the cleaning means and the drying means are used for the anus of the person.

* * * * *